US007236692B2

(12) United States Patent
Tran

(10) Patent No.: US 7,236,692 B2
(45) Date of Patent: Jun. 26, 2007

(54) SPA HEATER SYSTEM AND METHODS FOR CONTROLLING

(75) Inventor: Trong Tran, Huntington Beach, CA (US)

(73) Assignee: Balboa Instruments, Inc., Tustin, CA (US)

( * ) Notice: Subject to any disclaimer, the term of this patent is extended or adjusted under 35 U.S.C. 154(b) by 0 days.

(21) Appl. No.: 11/002,962

(22) Filed: Dec. 1, 2004

(65) Prior Publication Data

US 2006/0115248 A1 Jun. 1, 2006

(51) Int. Cl.
*H05B 3/60* (2006.01)
*H05B 1/02* (2006.01)

(52) U.S. Cl. ..... 392/318; 219/492

(58) Field of Classification Search ..... 392/488–489, 392/485, 466; 219/485, 488, 492, 497, 501; 4/541.1, 541.6

See application file for complete search history.

(56) References Cited

U.S. PATENT DOCUMENTS 4,506,144 A * 3/1985 Hesford et al. ..... 219/497
4,745,263 A * 5/1988 Brooks ..... 219/497
4,915,162 A * 4/1990 Ikura ..... 165/200
5,020,127 A * 5/1991 Eddas et al. ..... 392/488
5,361,215 A 11/1994 Tompkins et al.
5,479,558 A * 12/1995 White et al. ..... 392/485
5,550,753 A 8/1996 Tompkins et al.
5,559,720 A 9/1996 Tompkins et al.
6,374,046 B1 * 4/2002 Bradenbaugh ..... 392/463
6,476,363 B1 * 11/2002 Authier et al. ..... 219/481
6,590,188 B2 * 7/2003 Cline et al. ..... 219/497
6,643,108 B2 11/2003 Cline et al.
6,670,584 B1 * 12/2003 Azizeh ..... 219/485
6,806,446 B1 * 10/2004 Neale ..... 219/497
6,875,961 B1 * 4/2005 Collins ..... 219/494
6,976,052 B2 * 12/2005 Tompkins et al. ..... 709/201
2002/0020014 A1 * 2/2002 Authier et al. ..... 4/541.2
2005/0167419 A1 8/2005 Brochu et al.

FOREIGN PATENT DOCUMENTS

JP 1-298671 * 12/1989
JP 2-73413 * 3/1990
JP 3-208075 * 9/1991
JP 10-10917 * 1/1998

* cited by examiner

*Primary Examiner*—Sang Y. Paik
(74) *Attorney, Agent, or Firm*—Larry K. Roberts

(57) ABSTRACT

A spa system comprises an electrically powered heater. The electrically powered heater comprises a heating element capable of drawing a rated current when switched on to an AC line voltage. An electronic control system is programmed to control the heating element to draw less than the rated current.

10 Claims, 12 Drawing Sheets

| PUMP 1 | PUMP 2 | BLOWER | $I_{LC}$ | $I_{NH}$ Sum Col.1-4 | $I_{AV}$ Max $I_{SYS}$ -$I_{NH}$ | $I_H$ <$I_{AV}$ | System Current < 30 A(Max$I_{SYS}$) |
|---|---|---|---|---|---|---|---|
| 0 (Off) | 0A (Off) | Off (0A) | 1A | 1A | 29A | Off | 1A |
| 0 (Low) | 0A (Off) | Off (0A) | 1A | 1A | 29A | 25A | 26A |
| 10 (High) | 0A (Off) | Off (0A) | 1A | 11A | 19A | 18A | 29A |
| 0 (Low) | 0A (Low) | Off (0A) | 1A | 1A | 29A | 25A | 26A |
| 0 (Low) | 10A (High) | Off (0A) | 1A | 11A | 19A | 18A | 29A |
| 10 (High) | 0A (Low) | Off (0A) | 1A | 11A | 19A | 18A | 29A |
| 10 (High) | 10A (High) | Off (0A) | 1A | 21A | 9A | Off | 21A |
| 0 (Low) | 0A (Off) | On (5A) | 1A | 6A | 24A | 18A | 24A |
| 0 (Low) | 0A (Low) | On (5A) | 1A | 6A | 24A | 18A | 24A |
| 0 (Low) | 10A (High) | On (5A) | 1A | 16A | 14A | 10A | 26A |
| 10 (High) | 0A (Low) | On (5A) | 1A | 16A | 14A | 10A | 26A |
| 10 (High) | 10A (High) | On (5A) | 1A | 26A | 4A | Off | 26A |

Fig. 9

SPA HEATER SYSTEM AND METHODS FOR CONTROLLING

BACKGROUND OF THE DISCLOSURE

A bathing system such as a spa typically includes a vessel for holding water, pumps, a blower, a light, a heater and a control for managing these features. The control usually includes a control panel and a series of switches which connect to the various components with electrical wire. Sensors then detect water temperature and water flow parameters, and feed this information into a microprocessor which operates the pumps and heater in accordance with programming. U.S. Pat. Nos. 5,361,215, 5,559,720 and 5,550,753 show various microprocessor based spa control systems. When in continuous use, the spa temperature is controlled by temperature sensors which measure the temperature of the water, and selectively activate a pump to circulate water, and a heater which raises the water to the temperature set by the user at the control panel.

Spa manufactures may make spas with similar control systems, but with differing power or requirements or specifications for the heater element or elements. In such circumstances, the manufacture may have to maintain inventory of various heaters with different specifications and construct spa systems with different current requirements with the different-rated heaters or heater elements, thereby incurring increased manufacturing costs.

Some spa systems utilize triacs for controlling the on/off condition of a heater. Triacs generate a certain amount of heat due to the current drawn through the triac, which may necessitate installing a heat sink for the triac, thereby incurring increased manufacturing costs.

BRIEF DESCRIPTION OF THE DRAWINGS

Features and advantages of the disclosure will be readily appreciated by persons skilled in the art from the following detailed description of exemplary embodiments thereof, as illustrated in the accompanying drawings, in which:

FIG. 9 illustrates a table with nominal current values for spa components.

DETAILED DESCRIPTION OF THE DISCLOSURE

Figure 1:
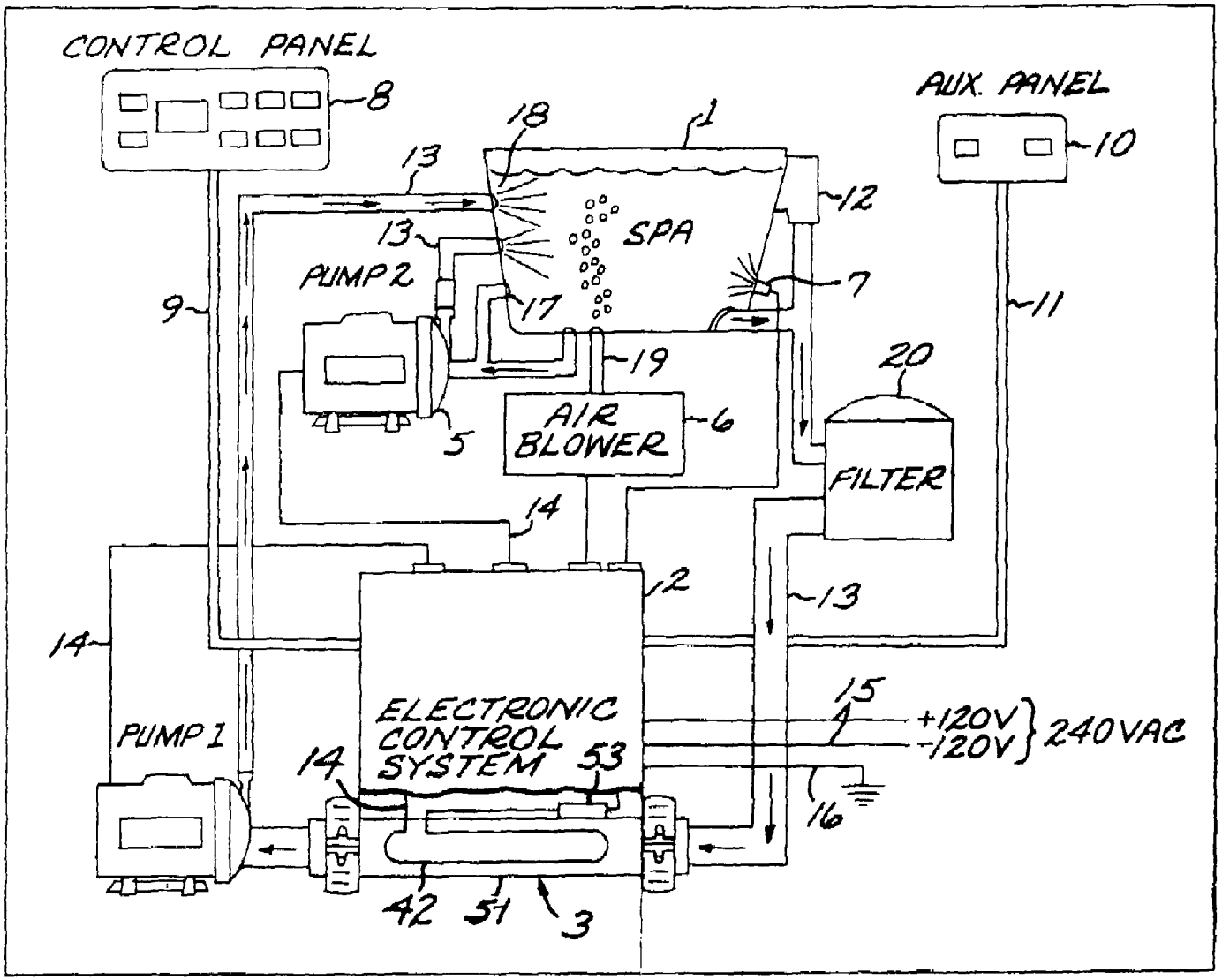
FIG. 1 is a schematic diagram of a system for bathers including a vessel for holding bathing water, a control system, and associated water management equipment.

In the following detailed description and in the several figures of the drawing, like elements are identified with like reference numerals.

FIG. 1 illustrates an overall block diagram of an exemplary embodiment of a spa system. The system includes a vessel 1 for holding a volume of water, and a control system 2 to activate and manage the various parameters of the spa. Connected to the vessel 1 through a series of plumbing lines 13 are pumps 4 and 5 for pumping water, a skimmer 12 for cleaning the surface of the vessel, a filter 20 for removing particulate impurities in the water, an air blower 6 for delivering therapy bubbles to the vessel through air pipe 19, and an electric heater 3 for maintaining the temperature of the spa at a temperature set by the user. In an exemplary embodiment, the electric heater 3 includes one or more resistive heating coils or elements 42 and a heater shell 51. In an exemplary embodiment, the heater shell 51 may comprise stainless steel. In exemplary embodiments, the heating elements may be wet or dry. In FIG. 1, the heating elements are shown in the fluid flow path. In other embodiments, the heating elements may be arranged in a dry portion of a heater 3. Generally, a light 7 is provided for internal illumination of the water.

Service voltage power is supplied to the spa control system at electrical service wiring 15, which can be 120V or 240V single phase 60 cycle, 220V single phase 50 cycle, or any other generally accepted power service suitable for commercial or residential service. An earth ground 16 is connected to the control system and there through to all electrical components which carry service voltage power and all metal parts. Electrically connected to the control system through respective cables 9 and 11 are the control panels 8 and 10. All components powered by the control system are connected by cables 14 suitable for carrying appropriate levels of voltage and current to properly operate the spa. Water is drawn to the plumbing system generally through the skimmer 12 or suction fittings 17, and discharged back into the vessel through therapy jets 18.

Figure 2A:
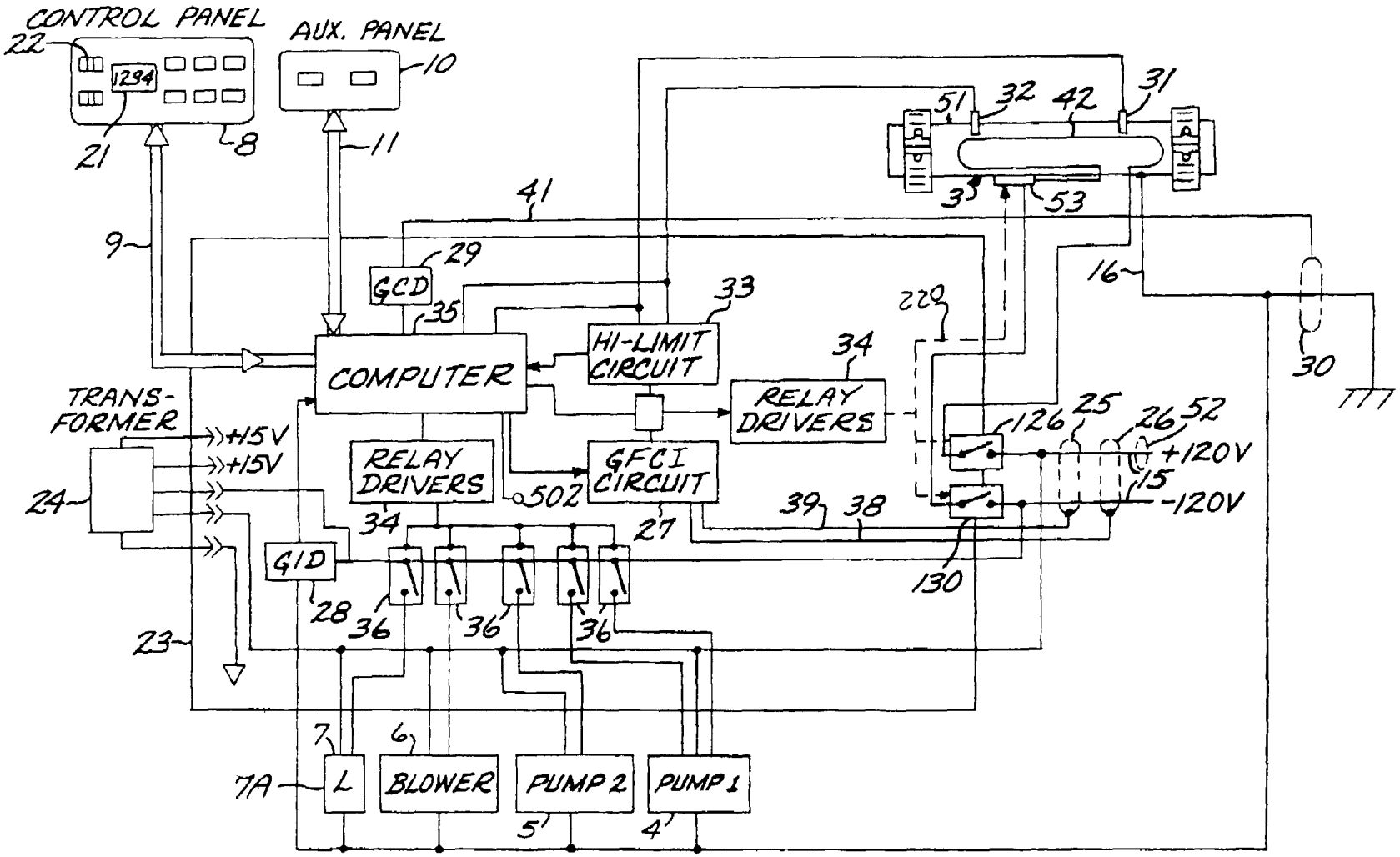
FIG. 2A is a schematic block diagram of an embodiment of a control for a spa system with various safety and water management features.

In an exemplary embodiment, the current or power provided to operate the heater 3 is controlled by the control system 2. In an exemplary embodiment, the current drawn by the heating elements is controlled using a triac 53, a thyristor or other suitable switching device, switch or current control circuit. The triac 53 may be connected to the controller by power cables 14 and control signal cable 220 (FIG. 2A). One exemplary commercially available triac device which is suitable for an exemplary embodiment are the BTA40 and BTA/BTB41 models, marketed by ST Microelectronics. In an exemplary embodiment, the control system 2 is pre-programmed by the manufacturer to have a pre-set maximum current or power setting, corresponding to the desired power or current rating of the particular spa application for which the controller is being manufactured. In an exemplary embodiment, the current or power provided to the heater 3 and/or heater elements 42 may be controlled to ensure that the total current drawn by the spa system does not exceed the current rating for the spa system. In an exemplary embodiment, the total current being drawn by the non-heater components of a spa system may be determined by a current sensor (using closed loop control) or by calculation of the nominal, expected current or power expected to be drawn by the various components, based on the components' ratings and which components are being operated and at what level they are being operated.

In an exemplary embodiment, the triac 53 may be mounted directly on the outer surface of the heater shell 51. In an exemplary embodiment, the heater shell 51 and the water passing through the heater shell act as a heat sink to remove heat from the triac. Mounting the triac directly on the heater shell 51 may eliminate a need to install a separate heat sink for the triac. In an exemplary embodiment, the triac may be mounted on the heater shell by welding the triac directly to the heater shell, attaching the triac with adhesives, or welding mounting studs to the heater shell and mounting the triac on the studs using threaded nuts or the like.

Figure 2B:
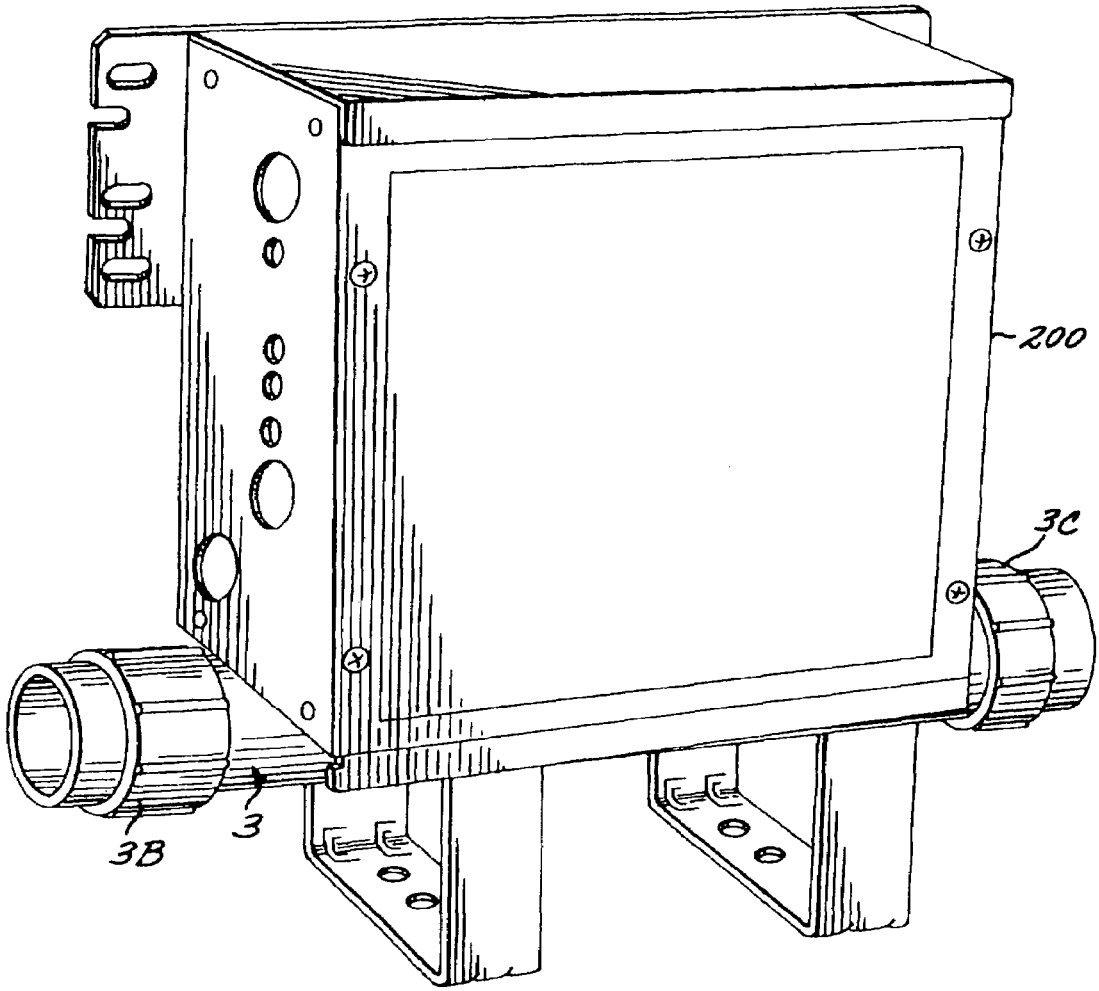
FIG. 2B is an isometric view of an exemplary embodiment of the control circuit board assembly enclosure and attached heater assembly.

An exemplary embodiment of an electronic control system for a spa is illustrated in schematic form in FIG. 2A. In an exemplary embodiment, the control system circuit assembly board may be housed in a protective metallic enclosure 200, as illustrated in FIG. 2B. The heater assembly 3 may be attached to the enclosure 200, and includes inlet/outlet ports 3A, 3B with couplings for connection to the spa water pipe system. Referring again to FIG. 2A, the electronic control system 2 includes a variety of electrical components generally disposed on a circuit board 23 and connected to the service voltage power connection 15. Earth ground 16 is brought within the enclosure 200 of the electronic control system and is attached to a common collection point.

Adjacent to the circuit board 23 and connected via an electrical plug, a power and isolation transformer 24 is provided. In an exemplary embodiment, the transformer may be located on the board. This transformer converts the service line power from high voltage with respect to earth ground to low voltage, fully isolated from the service line power by any of a variety of other suitable methods.

Figure 6:
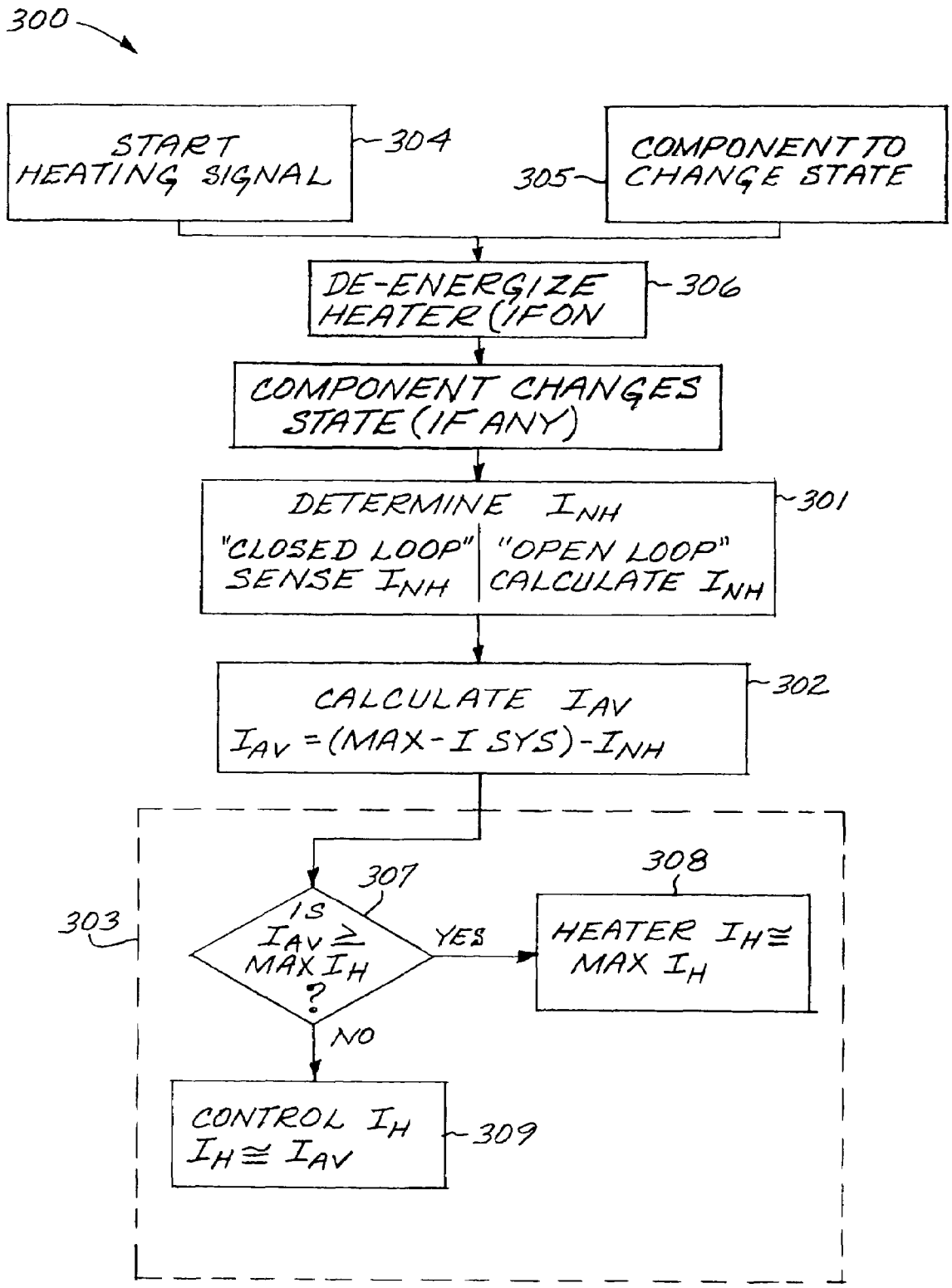
FIG. 6 illustrates a flow diagram for an exemplary heater control algorithm.

Also provided on the circuit board 23, in this exemplary embodiment, is a control system computer 35, e.g. a microcomputer such as one of the PIC 18F6xxx series CMOS microcomputer marketed by Microchip, which accepts information from a variety of sensors and acts on the information, thereby operating according to instructions described more fully in FIG. 6. The invention is not limited to the use of a controller including a microcomputer, microprocessor or electronic control system, whose functions can instead be performed by other circuitry, including, by way of example only, an ASIC, or by discrete logic circuitry.

One output of the computer 35 is displayed on the control panel 8 through a character display system rendered optically visible by technology generally known in the art. Tactile sensors 22 are provided to convert user instructions to computer readable format which is returned to the control system computer 35 via cable 9.

Exemplary equipment for heating and managing the water quality, i.e. the heater system 3, pumps 5 and 6, blower 4 and light 7, are connected via electrical cables 14 to relays 36, 126 and 130 on the circuit board 23, which function under the control of relay drivers 34, selectively driven by the microcomputer 35. In an exemplary embodiment, the relays may also be located off of the board. These relays and relay drivers function as electrically controlled switches to operate the powered devices, and provide electrical isolation from the service voltage power for the low voltage control circuitry. Of course, other types of switching devices can alternatively be employed, such as SCRs and triacs.

In an exemplary embodiment, the control system includes a triac 53 which may be selectively driven by one of the drivers 34. In an exemplary embodiment, the driver 34 may be, for example, a Darlington driver. The triac may be mounted directly on the outer surface heater shell 31 of the heater 3 or directly on the surface of any other portion of the spa water pipe system through which the water flow path flows. In an exemplary embodiment, the water flowing through the water flow path may remove heat generated in the triac during operation. In an exemplary embodiment, this may obviate the need for installing a separate heat sink for the triac. In another embodiment, the triac or other current controlling device may be mounted on the controller circuit board or on a separate heat sink.

Figure 3:
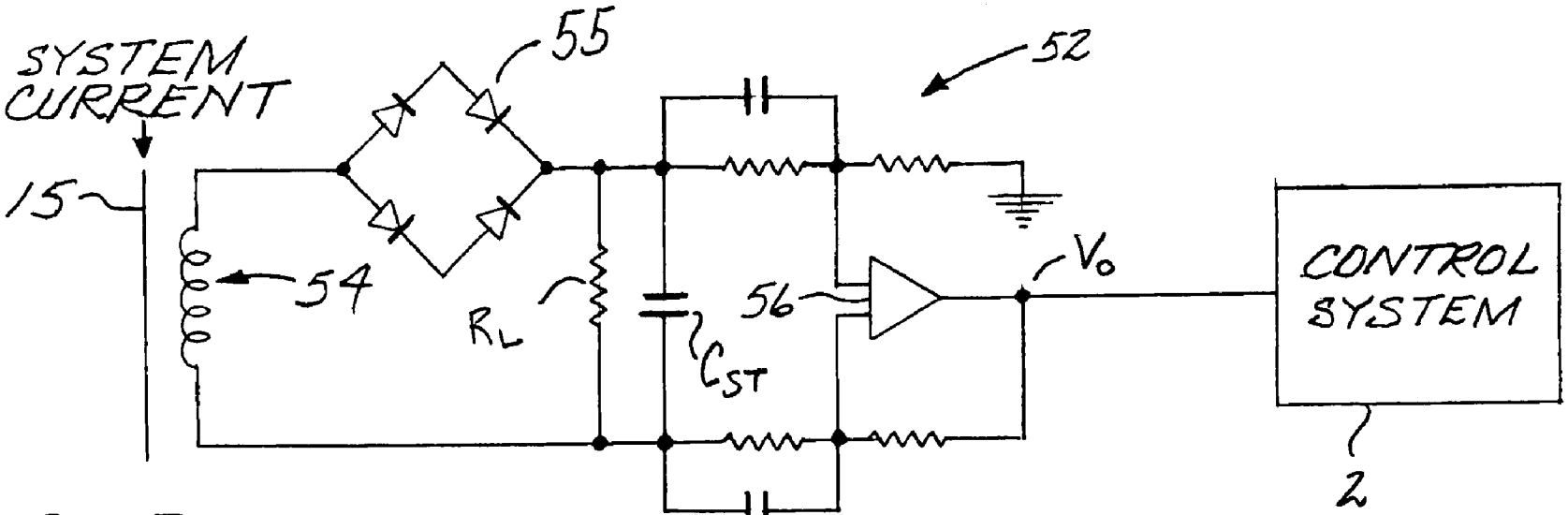
FIG. 3 illustrates schematic circuit diagram of an exemplary embodiment of a current sensor.

In an exemplary embodiment, the control system comprises a current sensor 52. FIG. 3 illustrates a circuit diagram of an exemplary embodiment of the current sensor 52. In an exemplary embodiment, the current sensor comprises a current sensing transformer 54 arranged to sense the current through at least one of the power leads 15. In an exemplary embodiment, the sensor comprises a bridge 55, a resistor $R_L$, a capacitor with a capacitance CST and a differential amplifier 56. In an exemplary embodiment, the voltage Vo at the output of the differential amplifier is proportional to the current load drawn by the power lead: $Vo=(C_{ST}\times R_L)\times A_{VA}$, where $A_{VA}$ is the current passed through the lead 15. In an exemplary embodiment, this signal is input to the control system 2. The control system may use the input Vo to determine the current and power drawn by the system.

Figure 4A:
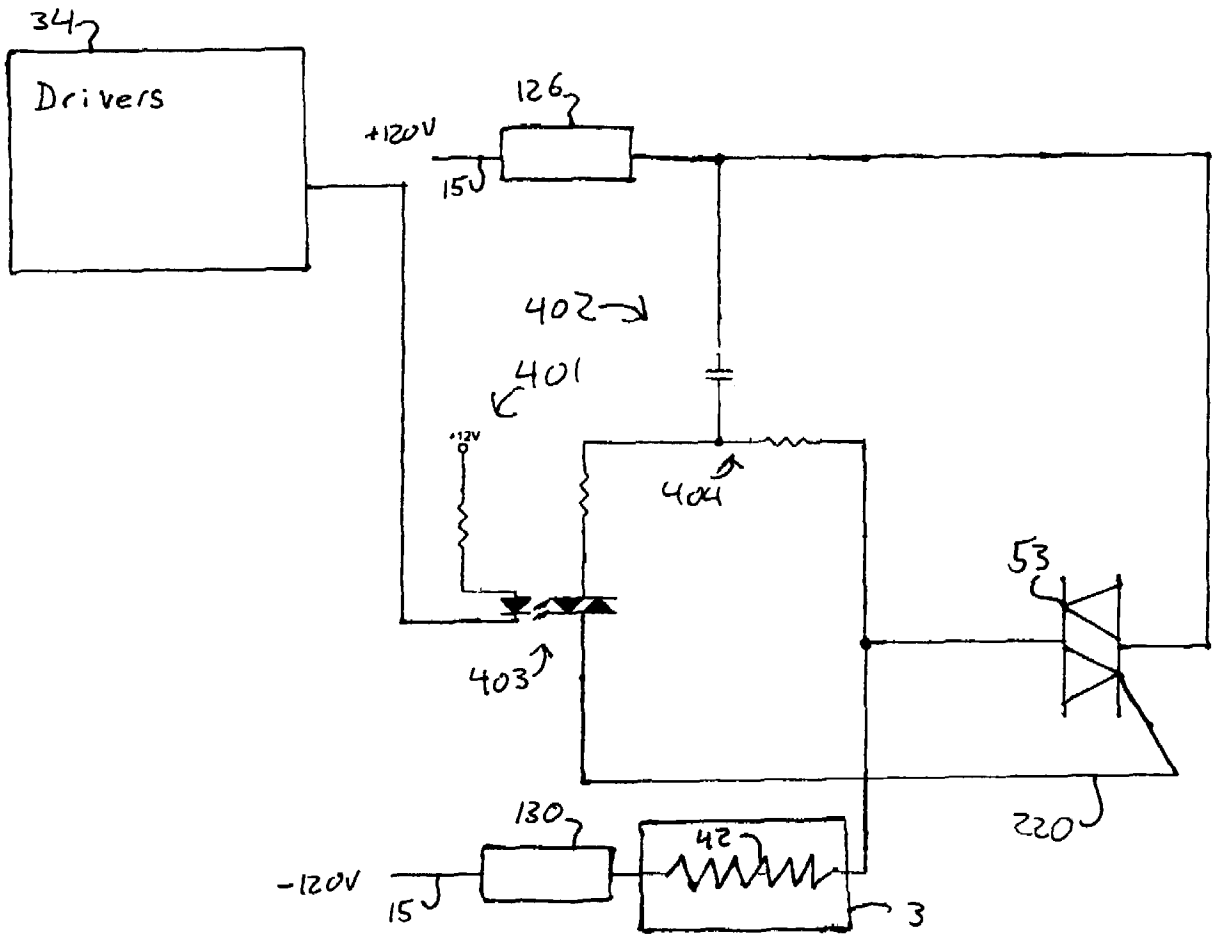
FIG. 4A illustrates an exemplary embodiment of a spa heater, controller system with optically isolated low and high voltage systems.

FIG. 4A illustrates an exemplary embodiment of a spa heater control system in which the low-voltage 401 is electrically isolated from the high voltage system 402. In an exemplary embodiment, the low-voltage system 401, which may include the control system and drivers 34, is electrically isolated from the high-voltage system 402 through an optically isolated switch 403. Isolation of the high-voltage system from the low-voltage system may prevent high voltage from leaking onto the low voltage system, which may prevent damage to low voltage components due to high voltage and may reduce hazards to people due to high voltage.

In an exemplary embodiment, the optically isolated switch 403 may be an optically isolated and triggered triac, such as a model MOC3021 triac. In an exemplary embodiment, the electrically isolated triac 403 receives a signal from the control system and/or driver, which provides an optical signal which, in turn, triggers voltage to pass through the electrically isolated triac 403 to provide the gate voltage pulse to the triac 53 through control line 220. In an exemplary embodiment, a snubbing circuit 404 may prevent false triac triggering due to transients and may limit the current through the optically isolated triac 403. In an exemplary embodiment, a line voltage service wiring 15 provides power to the triac 53 through a relay 26. When the triac 53 is triggered, voltage flows through the triac 53 and through the heater 3 and heating element 42 and relay 130 to a line voltage service wiring 15.

Figure 4B:
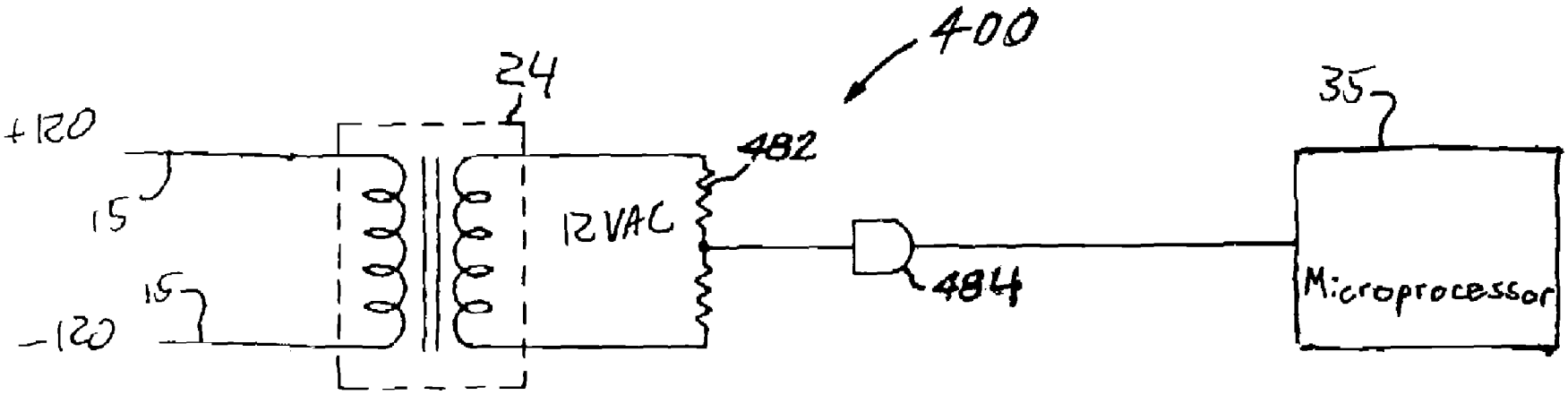
FIG. 4B illustrates an exemplary embodiment of a zero crossing detector.

FIG. 4B illustrates an exemplary embodiment of a zero detection circuit 400. An exemplary embodiment of a zero detection circuit was discussed in commonly assigned U.S. Pat. No. 6,643,108. In an exemplary embodiment, line voltage is provided to a transformer 24 by service wiring 15. The transformer 24 transforms the input voltage, which may be 240 V AC, to 12 VAC. The 12 VAC may be applied to a voltage divider 482, and the sinusoidal divider voltage drives the input to gate 484, which converts the sinusoidal input signal to a square wave signal between 0V and +5V. The microprocessor 35 monitors the square wave signal, and will sense nulls—or zero crossings—in the power waveform. In an exemplary embodiment, the microprocessor 35 times control signals for controlling the current drawn by a heater with reference to the sensed time of the nulls or zero crossing.

Figure 5:
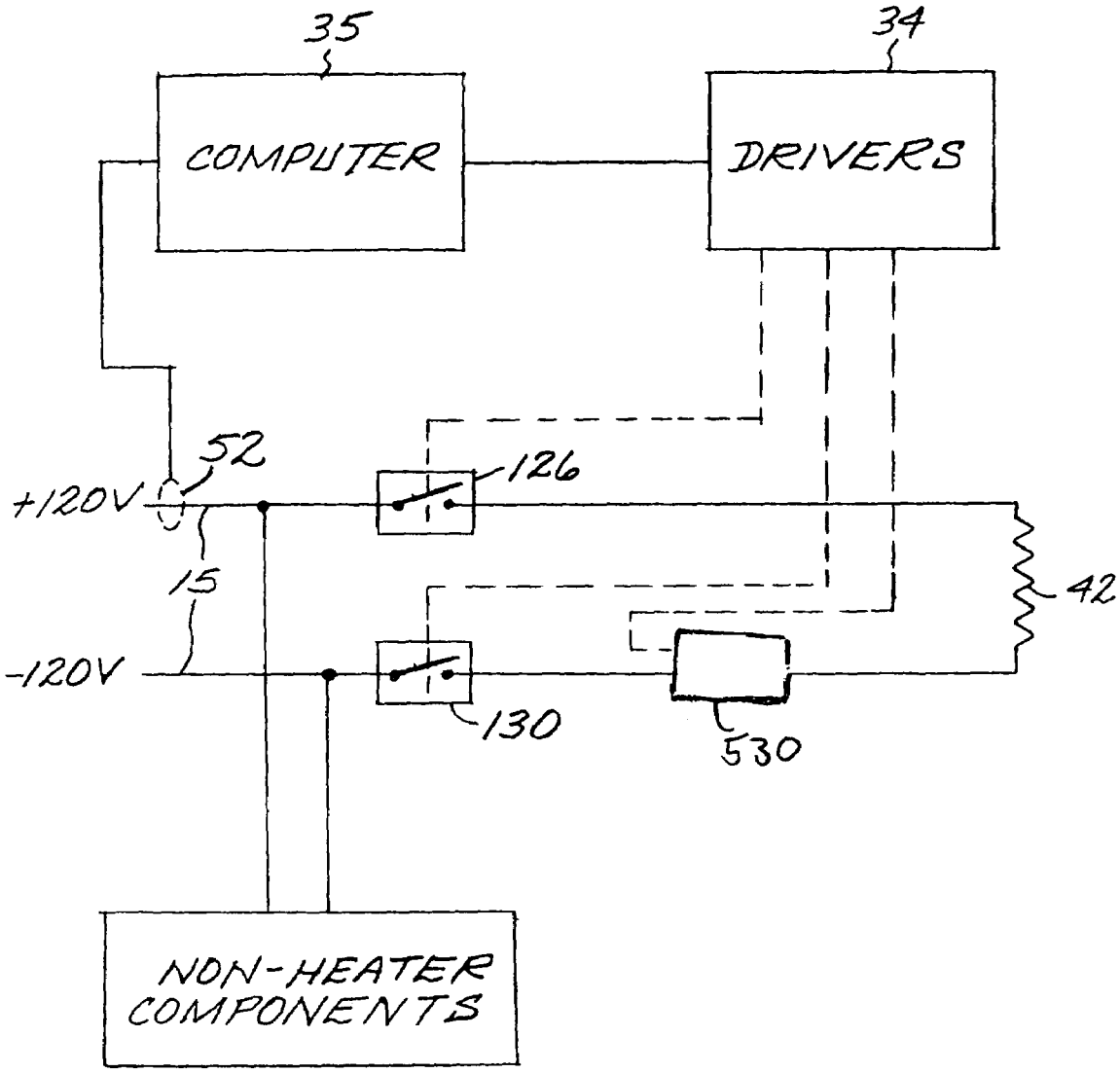
FIG. 5 illustrates a schematic block diagram of an embodiment of a control for a spa system.

FIG. 5 illustrates a circuit schematic of a portion of an exemplary control system for controlling current drawn by the heater 3. In an exemplary embodiment, the control system includes high limit relays 126, 130 on each of two power leads 15. In an exemplary embodiment, the heater element 42 is connectable to one of the power leads 15 through relay 126. The heater element 42 is connectable to the other power lead 15 through high limit switch 130 and through a current control circuit 530, which in an exemplary embodiment may include a triac. In an exemplary embodiment, the computer 35 is programmed to control current and power drawn by the heater element 42. In an exemplary embodiment, the computer controls the current and power drawn by the heater element 42 by sending signals from one of the drivers 34 to the current control circuit 530 to selectively prevent current from flowing to the heater element 42 during at least a portion of each of successive cycles of an AC line voltage.

FIG. 6 illustrates an exemplary embodiment of an algorithm 300 for controlling the heater. In exemplary embodiments, the algorithm includes: determining 301 the non-heater current ("$I_{NH}$"—or current drawn by system components other than the heater); calculating 302 the available current capacity ("$I_{AV}$"—or the current available for energizing the heater 2); and controlling 303 the heater current ("$I_H$"—or the current drawn by the heater). In an exemplary embodiment, the control system may be pre-programmed to limit the maximum heater current ("max $I_H$") to a pre-set maximum heater current.

In an exemplary embodiment, the control algorithm 300 may comprise at least one of either an "open loop" control algorithm or a "closed loop" algorithm. In an exemplary "open loop" algorithm, determining 301 the non-heater current includes calculating the non-heater current based on pre-programmed nominal current values representing known operating conditions for various system components. For example, in an exemplary "open loop" system, the controller may add the nominal expected current values for the various components in the table, based on their known or monitored operating conditions or states (for example, on/off, fast/slow, high/low/intermediate, numbers of pumps/blowers). In an exemplary embodiment, this is accomplished by retrieving nominal expected currents from a look-up table stored in memory and adding them to determine the non-heater current. In an exemplary "closed loop" algorithm, determining 301 the non-heater current includes sensing the non-heater current with the current sensor 52 as shown and described in FIG. 3.

In an exemplary embodiment, the control algorithm includes calculating the available current capacity ($I_{AV}$) by subtracting the non-heater current ($I_{NH}$) from a pre-programmed maximum system current value or parameter (max-$I_{sys}$) according the following formula: $I_{AV}$=max $I_{sys}$–$I_{NH}$. In an exemplary embodiment, controlling 303 the heater current comprises first determining 307 whether the available current capacity is greater than the maximum allowed heater current. If the available current capacity is greater than the max heater current, then the heater can be turned on with a heater current equal to about the pre-programmed maximum allowable heater current. In an exemplary embodiment, the control system may be programmed to raise the heater current over time to reach the allowable heater current after some time. Slowly increasing the heater current to the desired operating current may help prevent inadvertent circuit breaker trips where too much current is drawn. In an exemplary embodiment, when the current available is not greater than the preprogrammed maximum heater current, then the controller controls the heater current to be about equal to or less than the available current capacity. In an exemplary embodiment, the controller may control the heater current to be below the available current capacity to leave a cushion for the purpose of avoiding some unintended over-current trips in circumstances in which the system current is higher than expected.

In an exemplary embodiment, the algorithm is started each time heating is to begin, in response to a start heating signal 304 and/or whenever a component, such as, for example, a pump, blower or light, in the spa system changes state 305, for example is started, stopped, or changes state. In an exemplary embodiment, after the start heating signal 304 is received—or when a component is to change state 305, current to the heater element 42 is de-energized 306 (if already energized). In an exemplary embodiment, the heater is de-energized after the signal to change the component's state, but prior to permitting the component to change state. In an exemplary embodiment, de-energizing 306 prior to changing the state of a component may prevent momentary power spike exceeding the system current rating. In an exemplary embodiment, de-energizing 306 the heater enables the control system to determine the non-heater current while the heater is not drawing current. In an exemplary embodiment, the component to change state (if any) is permitted to change state 310 after de-energizing the heater and before determining 301 $I_H$.

FIGS. 7A-7D illustrate an exemplary embodiment of a method of controlling the heater current. In an exemplary embodiment, AC line voltage is provided to the heater. The AC line voltage has a frequency and corresponding period—for example 60 cycles per second or 50 cycles per second, each with a corresponding period equal to about $1/60^{th}$ of a second or $1/50^{th}$ of a second, respectively. In an exemplary embodiment, the power applied to the heater may be controlled by limiting the current drawn during each period by switching the triac on at a time after the start of a cycle—and before the end of the first half-cycle—and/or at a time after the start of the second half-cycle and before the end of the cycle. The desired current or power to be drawn by the heating element can be varied by changing the timing of a gate voltage pulse $V_G$ applied to the triac. In an exemplary embodiment, the gate voltage pulse $V_G$ is sufficient to trigger the triac to start permitting current to be drawn by the heating element. In an exemplary embodiment, the gate voltage pulse $V_G$ is a short pulse that ends prior to the end of the half-cycle during which the triac is fired. This ensures that the heating element will draw current during a known portion of a given half-cycle and then will stop drawing current at the beginning of the next half-cycle (after the current crosses zero). In other words, the duty cycle of the heater, or the percentage of a half-cycle or cycle during which current flows to the heating element, is varied to achieve a desired current or power drawn by the heating elements. Depending on the power or current desired, the triac fires at a different phase of the AC line voltage half-cycle for a brief, fixed period of time. In an exemplary embodiment, this can be repeated every half-cycle and could, optionally, be skipped every other half-cycle to facilitate a greater range of current set points. The heater current or power is determined by the firing phase, whether it is fired every half-cycle or every other half-cycle. The earlier in the cycle at which the triac fires, the greater the fraction of the half-cycle that is presented to the heater, and the greater the current or power at which the heater is run.

Figure 7A:
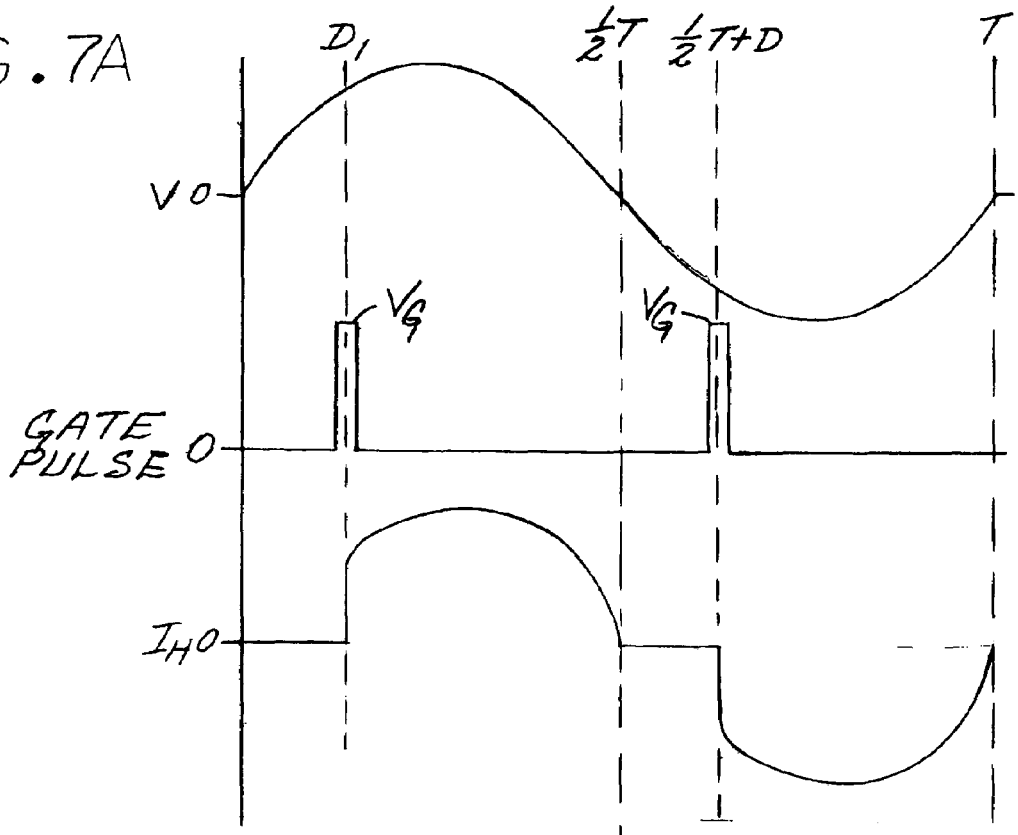
FIGS. 7A-7D illustrate the relationship among the voltage, heater current and triac gate voltage for exemplary embodiments of heater current control methods.
Figure 7B:
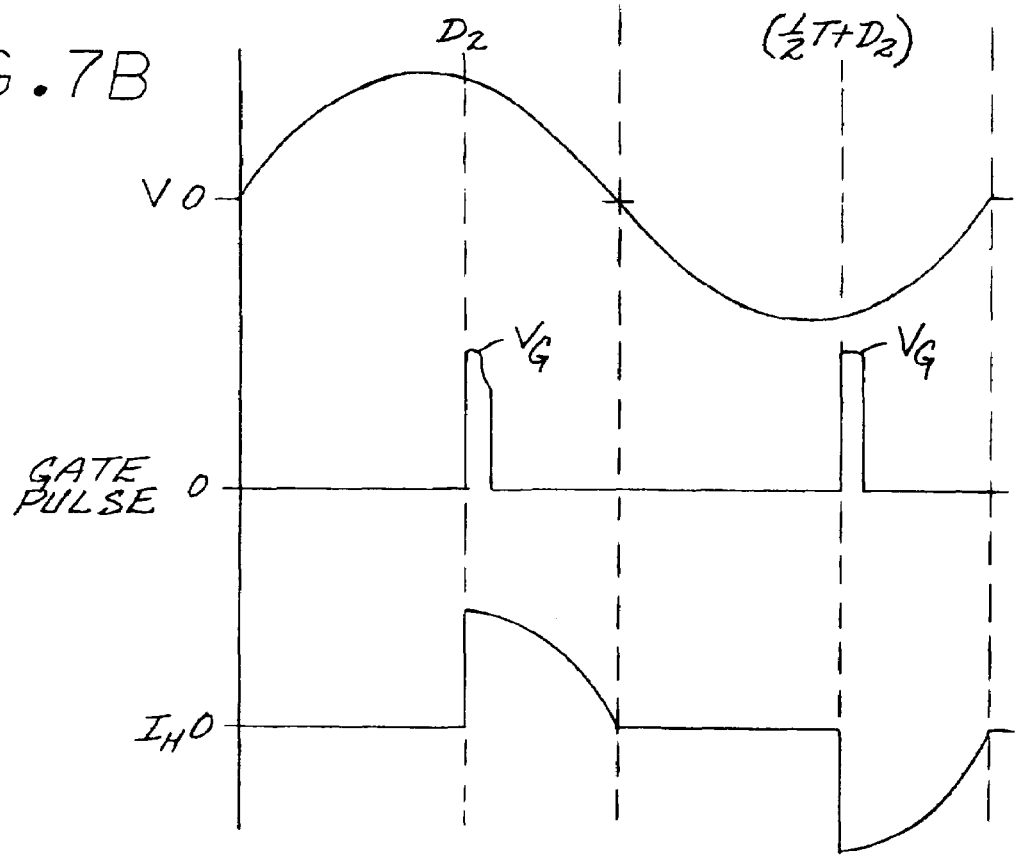

In an exemplary embodiment, current is permitted to flow through a triac when a voltage pulse greater than a threshold voltage is applied to the gate. If the gate voltage is not provided until after a portion of the cycle has passed, then the total current drawn during the cycle will be limited to the current which passes after the gate voltage pulse is applied. For example, in FIG. 7A, the AC line voltage provided to the system has a period of T. A gate voltage pulse is provided at a time delta and at a time ½ T plus D1. The triac is triggered to permit current to be drawn through the heater from about time D1 through about time ½ T and from ½ T+D1 through time T. The resultant current drawn through the heater is less than would have been drawn through the heater during that period of time if the current had not been prevented from flowing to the heater during a portion of the cycle. The current drawn through the heater and the corresponding power used by the heater can be adjusted by varying the timing of the pulse within a cycle (the phase of the pulse) at which the triac is triggered to permit current to pass. In FIG. 7B, for example, the power to the heater is controlled to be at a lower average current and lower power level than in FIG. 7A. The triac is controlled by a control pulse timed to occur later during the cycle, namely at time delta2 and at time ½ T plus D2. The heater draws current and power during a correspondingly shorter portion of the cycle. In an exemplary embodiment, the timing of the trigger pulse is set with reference to the time of zero crossing as determined by the zero detection circuit 400 (FIG. 4B).

In an exemplary embodiment, the correspondence between a particular timing or phase of a gate voltage pulse and the resulting current drawn through the heater can be determined by calculation or by trial and error. The electronic controller or microcomputer may be programmed to send gate voltage pulses at a particular time, timing or phase of a cycle to achieve a particular, desired current flow through the heater or heating element. In an exemplary embodiment, gate voltage pulses may be sent during one or both half-cycles of a cycle, which may permit a broader range of current control. In an exemplary embodiment, the resolution of the timing to achieve particular desired currents may depend on the frequency of the AC line voltage, the particular triac or microprocessor used. In an exemplary embodiment, a microcomputer-controlled triac may control the current through an exemplary heater from zero to 20 Amps, with gradations as fine as about ½ Amp steps.

Figure 7C:
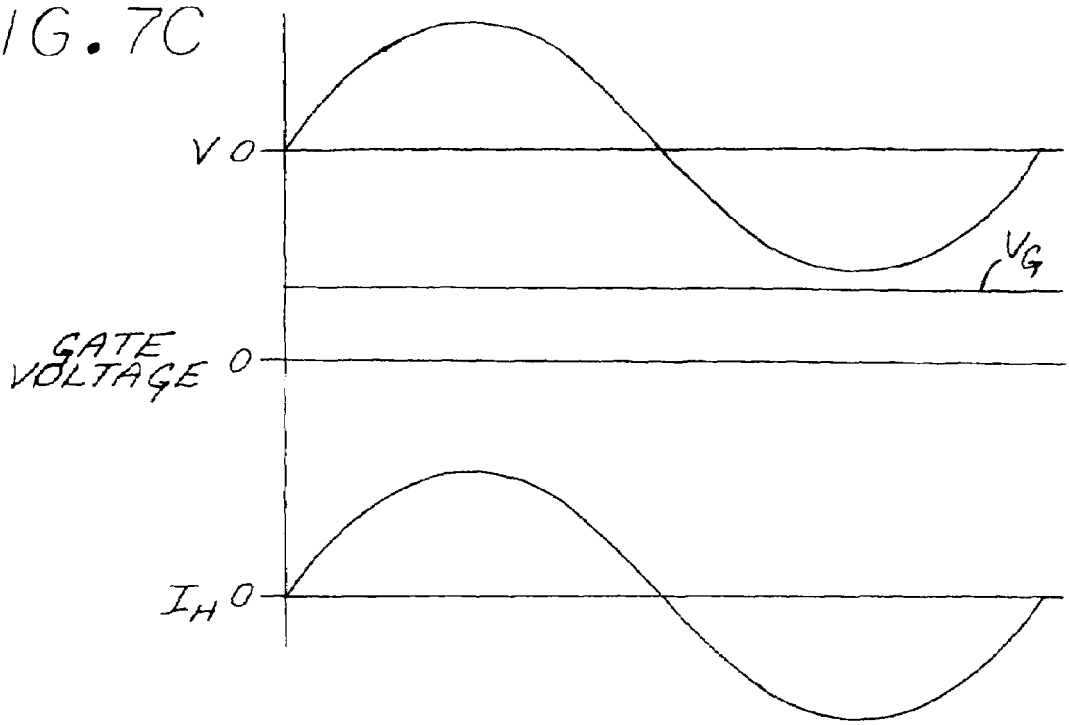
Figure 7D:
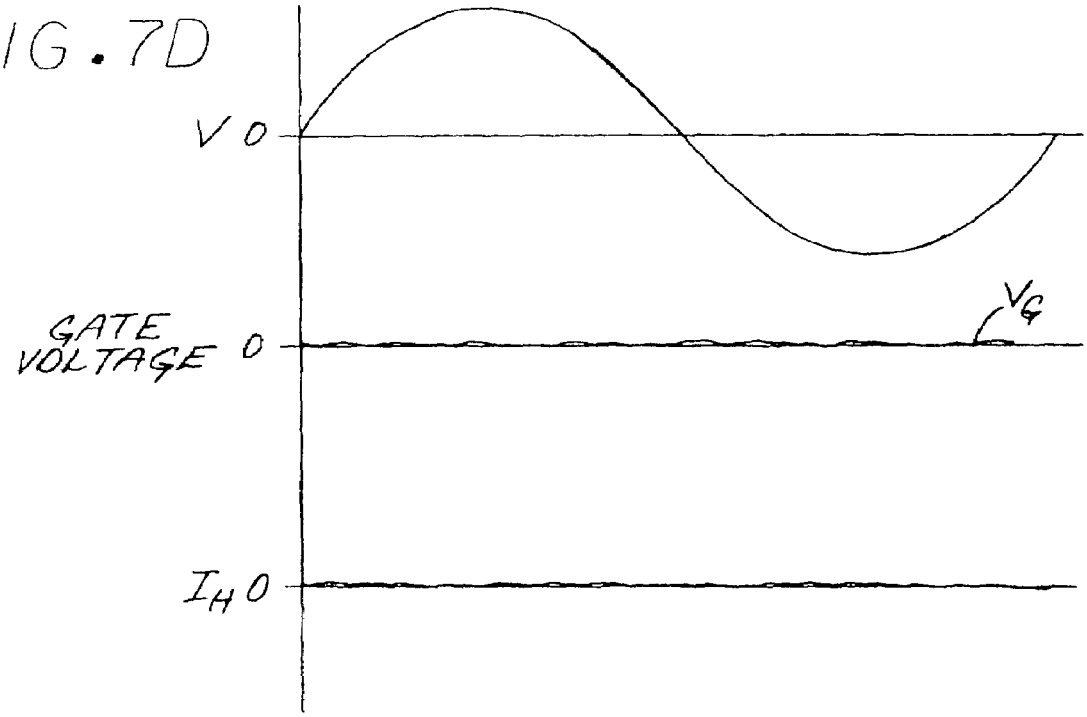

In an exemplary embodiment, the triac can control the heater to be energized at max heater current or to be off. In FIG. 7C, for example, the triac is controlled to be on, throughout the entire cycle. The triac is controlled to be on by a constant control voltage higher than the trigger voltage for the triac. In an exemplary embodiment, the trigger voltage may be 5 V. In this embodiment, the heater draws the full rated maximum power and current for the heater. In an exemplary embodiment, the heater will be controlled to full power when the available current capacity is greater than the maximum allowable current. In FIG. 7D, the power to the heater is controlled to be zero. The triac does not receive any control pulse, whereby the current does not flow to the heater and the heater does not draw any power. In an exemplary embodiment, the timing of the trigger pulse can be varied to adjust the current drawn by the heater.

Figure 8:
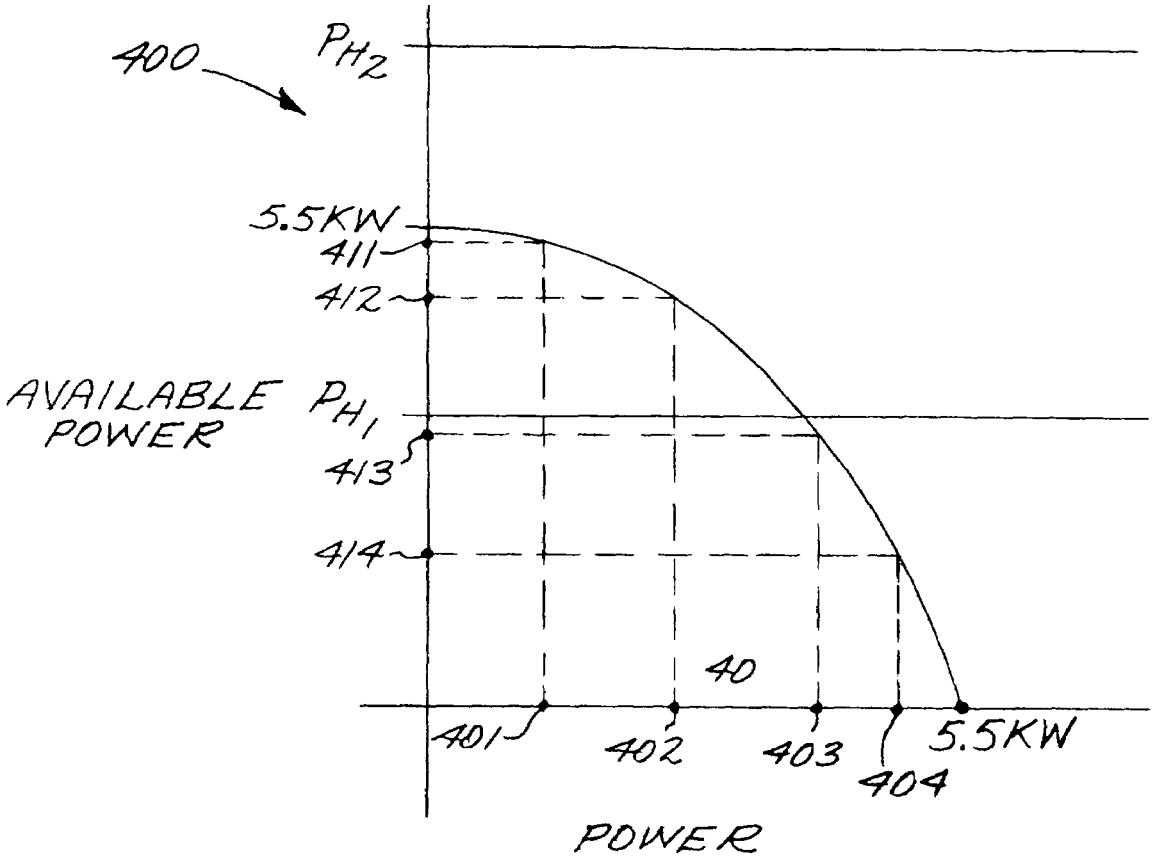
FIG. 8 illustrates a graphical representation of a method of controlling heater current

In an exemplary embodiment, the controller is programmed to vary the current to the heater in response to the current or power available for the heater. FIG. 8 illustrates a graphical representation of the power available for the heater. In the exemplary embodiment of FIG. 8, for example, the system power available is 5.5 KW. The y-axis represents the available power. The x-axis represents the non-heater power. If, for example, one pump with no blowers draws power 401, the available power for operating a heater will be at corresponding level 411. If one pump and one blower is operating, for example, the power drawn 402 would correspond to a correspondingly smaller available power 412. Similarly, the power drawn by two pumps and one blower 403 and two pumps and two blowers 404 would correspond to increasingly lower available powers 413, 414, respectively. In an exemplary embodiment, the pre-programmed maximum heater current will correspond to a maximum heater power $P_{H1}$. When the available power exceeds the maximum heater power $P_{H1}$, the heater can be operated at full current drawing capacity. If, however the maximum heater power $P_{H2}$ is greater than the available power at all points of the curve, the heater current and power will be controlled at all times to be less than the maximum heater power and/or maximum heater current. In other words, the heater would never be operated at full current drawing capacity for this example.

In an exemplary embodiment, a spa system may be rated for 30 A. In an exemplary embodiment, the various low-current components (including, for example, low-speed pumps, a microcomputer and other small current loads) may be expected to draw about 1 A total among them ($I_{LC}$) (Note: the current for low speed pumps is show as 0, only because in this embodiment, the current is negligible and is accounted for in the low-current component current ($I_{LC}$). In an exemplary embodiment, two pumps may each draw 10 A at high speed and a blower may draw 5 A when on. In an exemplary "open loop" system, these nominal current values may be pre-programmed in to the controller or stored in memory. FIG. 9 illustrates a table showing the operating state of two pumps, a blower and the available current capacity. The table also shows the calculated non-heater component current ($I_{NH}$) and available current capacity $I_{AV}$). The controller controls the current drawn through the heater to be IH, which is controlled to maintain the total system current below the maximum system current rating ($MaxI_{SYS}$). In an exemplary embodiment, the controller may control the heater current to be near the available heater current capacity, for example about three or four amps below the available current capacity. This may leave a cushion to prevent any unintended over-current trips in the event of unexpected current variations. For each set of operating conditions, the heater current is controlled to permit continued heating while remaining below the total system rating.

In an exemplary embodiment, a manufacturer may construct a spa heater, controller assembly which is suitable for use in various spa system products, or different lines of spas, each with different maximum current and power specifications. In an exemplary embodiment, the spa heater, controller assembly may use one heating element with a particular maximum heater current rating for each of the various spa lines. In an exemplary embodiment, the heater, controller assembly or system can be pre-programmed with a maximum heater current and/or a maximum system current. The controller may control the current through the heater, in any of various spa systems, to not exceed the maximum system current limits. For example, a spa system with a total system current rating of 30 A may be manufactured With a spa heater controller system having a 25 A rated heater, as discussed above with respect to FIG. 9. A second spa line, with a total system current rating of 25 A could also be manufactured using the same 25 A heater controller system as the 30 A spa line. The controller system may be pre-programmed to maintain the system current below the maximum system current rating. Similarly, a spa system with a higher maximum system current rating, for example 35 A, could be manufactured using the same heater controller system with the 25 A heater. This may avoid the need to keep heaters with different current ratings in stock for use in spa lines with differing current ratings. The controller may avoid over-current conditions by modulating the heater current so that the total system current does not exceed a preset limit and/or modulate the heater current so that the heater current does not exceed a pre-set heater current limit. This enables a manufacturer or distributor to keep fewer kinds of heaters in stock and increases the efficiency of the manufacturing process.

In an exemplary embodiment, the heater current can be controlled to draw an amount of current such that the system operates near but below the maximum current rating for the system. The heater current may then be adjusted down if another component is energized to draw additional current. For example, if the jets are operating at low speed, the heater can be adjusted to use a certain amount of current. If the jets are turned to a higher speed, the heater current can be adjusted downward so that the total system current does not exceed the system current rating. In an open loop system, the current adjustments may be made responsive to the nominal current values stored in memory for the components which are to be turned on. In an exemplary closed loop system, the current adjustments may be made responsive to the current sensed by the current sensor. In either case, the amount of heating provided during a given operating condition may be optimized; the controllable heater current avoids the need to cycle the heater off when other components are on in order to avoid an over-current condition.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A method of controlling a spa heater, comprising:

determining a current drawn by non-heater components of the spa;

calculating an available current capacity for the heater;

controlling a current drawn by the heater to equal approximately the available current capacity for the heater;

receiving a signal to change the state of one of the non-heater components;

de-energizing the heater prior to changing the state of the one of the non-heater components;

changing the state of the one of the non-heater components; and determining the current drawn by the non-heater components after changing the state of the one of the non-heater components.

2. The method of claim 1, wherein controlling the current drawn by the heater comprises setting the timing of a plurality of consecutive voltage gate pulses to a triac to control the time during each of a plurality of consecutive AC cycles during which the heater can draw current.

3. The method of claim 1, wherein controlling the current drawn by the heater comprises setting the timing of a plurality of consecutive voltage gate pulses to a triac to control the time during each of a plurality of consecutive AC cycles during which the heater draws current.

4. The method of claim 1, further comprising:

receiving a start heating signal; and determining the current drawn by the non-heater components prior to energizing the heater.

5. A method of controlling an electrically-powered heater in a bathing installation including a recirculating water flow path in fluidic communication with a bathing installation vessel for holding water and electrically-powered non-heater components, the method comprising:

receiving a signal to change the state of one of the non-heater components;

de-energizing the heater prior to changing the state of the one of the non-heater components;

changing the state of the one of the non-heater components;

determining the current drawn by the non-heater components after changing the state of the one of the non-heater components calculating an available current capacity for the heater;

controlling a current drawn by the heater to so that said current does not exceed the available current capacity for the heater.

6. The method of claim 5, wherein said determining a current drawn by the non-heater components comprises measuring the current being drawn by the bathing installation using a current sensor.

7. The method of claim 5, further comprising:

receiving a start heating signal; and determining the current drawn by the non-heater components prior to energizing the heater.

8. A bathing installation, comprising:

an electrically-powered heater;

a bathing installation vessel for holding water;

a recirculating water flow path in fluidic communication with the bathing installation vessel and the heater;

electrically-powered non-heater components;

a microprocessor-based control system, comprising:

a control algorithm for controlling the heater and the non-heater components to control a bathing installation environment including temperature of the bathing installation water;

means for changing the state of one of the non-heater components in response to a received signal or pursuant to the control algorithm;

means for de-energizing the heater prior to changing the state of the one of the non-heater components;

means for determining the current drawn by the non-heater components after changing the state of the one of the non-heater components while the heater is de-activated;

means for calculating an available current capacity for the heater;

means for activating the heater and controlling a current drawn by the heater to so that said current does not exceed the available current capacity for the heater.

9. The installation of claim 8, wherein the means for determining the current drawn by the non-heater components comprises a current sensor for measuring the current drawn by the installation.

10. The installation of claim 8, wherein the means for determining the current drawn by the non-heater components comprises means for calculating the current drawn by non-heater components responsive, at least in part, to a table of nominal current usage values stored in a memory.

* * * * *